United States Patent [19]

Aoyama

[11] Patent Number: 4,716,307

[45] Date of Patent: Dec. 29, 1987

[54] REGULATED POWER SUPPLY FOR SEMICONDUCTOR CHIPS WITH COMPENSATION FOR CHANGES IN ELECTRICAL CHARACTERISTICS OR CHIPS AND IN EXTERNAL POWER SUPPLY

[75] Inventor: Keizo Aoyama, Yamato, Japan

[73] Assignee: Fujitsu Limited, Kawasaki, Japan

[21] Appl. No.: 895,730

[22] Filed: Aug. 12, 1986

[30] Foreign Application Priority Data

Aug. 16, 1985 [JP] Japan ..... 60-179444

[51] Int. Cl.[4] ..... G05F 1/56; G05F 5/08

[52] U.S. Cl. ..... 307/297; 323/281; 323/303

[58] Field of Search ..... 307/297, 475; 323/299, 323/303, 281, 311, 316, 317, 349

[56] References Cited

U.S. PATENT DOCUMENTS

| | | | |
|---|---|---|---|
| 4,205,263 | 5/1980 | Kawagai et al. | 323/317 |
| 4,281,261 | 7/1981 | Adam | 323/315 |
| 4,430,582 | 2/1984 | Bose et al. | 307/297 |
| 4,477,737 | 10/1984 | Ulmer et al. | 323/316 |
| 4,555,642 | 11/1985 | Morales | 323/316 |
| 4,585,955 | 4/1986 | Uchida | 323/281 |

FOREIGN PATENT DOCUMENTS

| | | |
|---|---|---|
| 0015070 | 9/1980 | European Pat. Off. . |
| 0046482 | 3/1982 | European Pat. Off. . |
| 0063483 | 10/1982 | European Pat. Off. . |
| 0121793 | 10/1984 | European Pat. Off. . |

OTHER PUBLICATIONS

Chu, "On-Chip Constant-Current Compensator," IBM Tech. Discl. Bull., vol. 19, No. 2, pp. 500-501, Jul. 1976.

*Primary Examiner*—William H. Beha, Jr.
*Attorney, Agent, or Firm*—Staas & Halsey

[57] ABSTRACT

A semiconductor device having a circuit for regulating the external power supply voltage applied to the chip. When numerous chips are used in an electronic circuit having an external power supply voltage, variations in the electrical characteristics, such as the total power supply current, of each chip, become a problem. According to the present invention, variations in the electrical characteristics can be reduced by compensating the chip-to-chip fluctuations of the conductance of transistors (FETs) contained in an inner circuit disposed on the chip. A dummy transistor having a relatively short channel length is employed as a circuit for detecting the electrical characteristics of the transistors formed on the chip. The voltage drop across the dummy transistor is employed as a representative signal since it is sensitive to variations in the characteristics of the FETs contained in the inner circuit. Regulation of the power supply voltage is performed by a regulating device, usually a transistor, connected in series between the external power supply and the inner circuit. The representative signal is amplified by a regulating signal generating circuit whose output voltage is applied to the regulating device, thereby controlling the conductance of the regulating device.

14 Claims, 4 Drawing Figures

REGULATED POWER SUPPLY FOR SEMICONDUCTOR CHIPS WITH COMPENSATION FOR CHANGES IN ELECTRICAL CHARACTERISTICS OR CHIPS AND IN EXTERNAL POWER SUPPLY

BACKGROUND OF THE INVENTION

The present invention is directed to a semiconductor device including an integrated circuit (IC) or a large scale integrated circuit (LSI). In particular, the present invention is directed to a semiconductor device (hereinafter referred to as a semiconductor chip or a chip) having means for regulating an external power supply voltage applied thereto so as to compensate chip-to-chip dispersion of electrical characteristics of the chip, such as power supply current.

As the packing densities of ICs increases, especially metal oxide semiconductor (MOS) ICs, the dimensional structure of the semiconductor chip becomes very fine, as discussed in *Electronics*, Aug. 18, 1977, pages 94–99, by Richard Pashley et al., causing various problems during production. Thus, accuracy and preciseness of the relevant production technology of transistors is required.

For example, MOS field effect transistors (FETs) have had their channel length shortened to 2 μm. A MOSFET having a polysilicon gate electrode has a channel length defined by the width of the gate electrode since a self-aligned dopant ion implantation method forms source-drain regions of the associated MOSFET using the gate electrode as a mask. The accuracy of the dimensions of the gate electrode is adversely affected by an inadequate production process. That is, over-etching of the photoresist film (mask) for patterning the polysilicon gate electrode, incorrect lithography patterning of the photoresist film due to uneven substrate surfaces, over-etching of the polysilicon layer for forming the gate electrode, etc., adversely affect the device. Such fabrication processes are performed on every semiconductor wafer on which a number of semiconductor chips are built. The dimensions of the FETs, therefore, vary from wafer-to-wafer, that is, from chip-to-chip, in an integrated electronic circuit. For example, chip-to-chip dispersion of the channel length is approximately ±0.2 μm in MOSFETs presently produced. This causes approximately 10% dispersion of the electrical characteristics, such as conductance (gm), threshold voltage ($V_{th}$), and source-drain breakdown voltage, between devices. In contrast, the dispersion between individual FETs contained in one semiconductor chip is fairly small.

Generally, semiconductor chips or IC chips are mounted on a base and power is commonly supplied to individual chips from an external power source. As a result, problems due to variations in the electrical characteristics of each FET may arise, and problems such as too high a power supply current for chips containing high conductance FETs (i.e., FETs having a short channel length), and too low a power supply current and a low switching speed for chips containing low conductance FETs (i.e., FETs having a long channel length and a high gate-source capacitance) may occur. This results in degradation of the efficiency and stability of the circuit.

The above-described chip-to-chip variations in the electrical characteristics of FETs mounted on every chip is, at present, inevitable to some degree. It is rather difficult and costly to upgrade the accuracy and stability of the fabrication process of semiconductor chips. Thus, a solution is needed to overcome this problem.

SUMMARY OF THE INVENTION

It is an object of the present invention to provide a semiconductor chip having means capable of compensating chip-to-chip variations in the electrical characteristics of transistors mounted thereon in order to achieve a uniform and reliable operation of the semiconductor chip when many are used in an electronic circuit.

It is still another object of the present invention to provide a semiconductor chip having a regulating means for regulating an external power supply voltage applied thereto. The regulating means is controlled by a signal representing the electrical characteristics of the transistors mounted on each chip.

It is a further object of the present invention to provide high reliability semiconductor chips by economically compensating variations in the electrical characteristics of every chip caused by inherent non-uniformity of the associated production process.

The present invention includes a voltage regulating means which receives an external power supply voltage and which regulates the external power supply voltage and converts it to an internal power supply voltage to be applied to an inner circuit. A controlling means controls the voltage regulating means so that variations in the electrical characteristics of transistors in the inner circuit are compensated.

These objects and advantages, which will be subsequently apparent, reside in the details of the circuit configuration hereinafter described and claimed. Reference is made to the accompanying drawings, wherein like numerals refer to like parts throughout.

DESCRIPTION OF THE PREFERRED EMBODIMENTS

Figure 1:
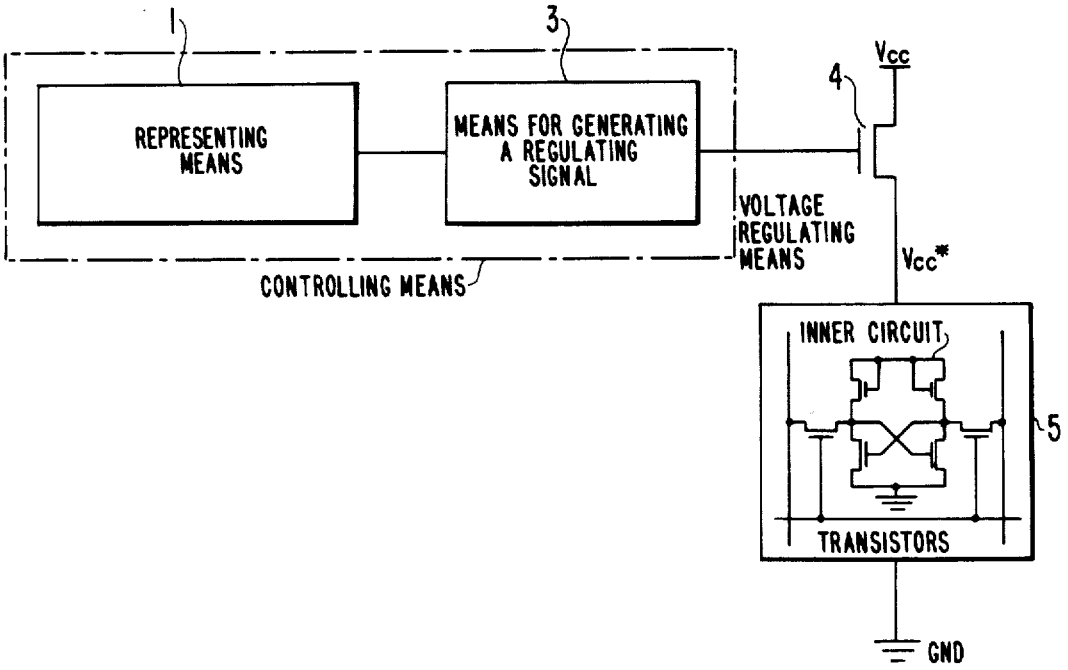
FIG. 1 is a block diagram of a power supply regulating circuit formed on a semiconductor device according to the present invention.

FIG. 1 is a block diagram of a power supply voltage regulating circuit formed in a semiconductor chip according to the present invention. The circuit comprises controlling means, including means 1 for providing a representing signal representing electrical characteristics of FETs in an inner circuit 5, means 3 for generating a regulating signal according to the representing signal, and voltage regulating means 4 for regulating an external power supply voltage. An external power supply voltage Vcc is applied to the inner circuit 5, such as a memory circuit formed on the semiconductor chip, through the regulating means 4 which regulates the voltage Vcc. The representing means 1 detects the electrical characteristics, such as conductance, of the FETs mounted in the inner circuit 5. The representing signal from the representing means 1 is fed to the regulating signal generating means 3, and the output signal therefrom is applied to the regulating means 4. Thus, the voltage Vcc is regulated to an internal power supply voltage Vcc* which is applied to the inner circuit 5, thereby compensating the chip-to-chip variations in the electrical characteristics of the FETs contained therein. As a resut, a semiconductor chip having, for example, FETs with rather high conductances, has an external power supply voltage Vcc regulated to a relatively low internal power supply voltage Vcc* which is applied to the inner circuit 5 of the chip. This avoids the application of a high power supply current to the chip which might otherwise occur.

A brief description of the relationship between the electrical characteristics and channel length of the FETs is now provided. Conductance of, for example, an FET, is inversely proportional to the channel length. An FET having a short channel length such as 2 μm, has a high conductance which varies with the channel length. The short channel length FET has well controlled electrical characteristics, therefore, it is very difficult to fabricate. On the other hand, a short channel length FET is suitable to monitor variations in electrical characteristics of FETs contained in the inner circuit 5 caused by fluctuations in production conditions. Thus, an FET with a short channel length is used as a sensitive dummy FET in the representing means 1.

An FET having a relatively long channel length, i.e., longer than 5 μm, has a low conductance and is insensitive to variations in the channel length. Such FETs are suitably used in the controlling means 1, except for the above-described dummy FET, because their electrical characteristics are less affected by the channel length and they can maintain a relatively stable function even under varying production conditions. Furthermore, dispersion of the power supply current to each semiconductor chip contained in an electronic circuit can be mainly attributed to the FETs having a high conductance (i.e., a short channel length).

The voltage drop across a dummy FET is utilized as a representative signal representing the electrical characteristics of FETs in the inner circuit 5. Since the dummy FET and the FETs of the inner circuit 5 are fabricated on the same wafer and under the same fabrication conditions, the dummy FET and some of the FETs of the inner circuit 5 have a short channel length similar to each other.

Figure 4:
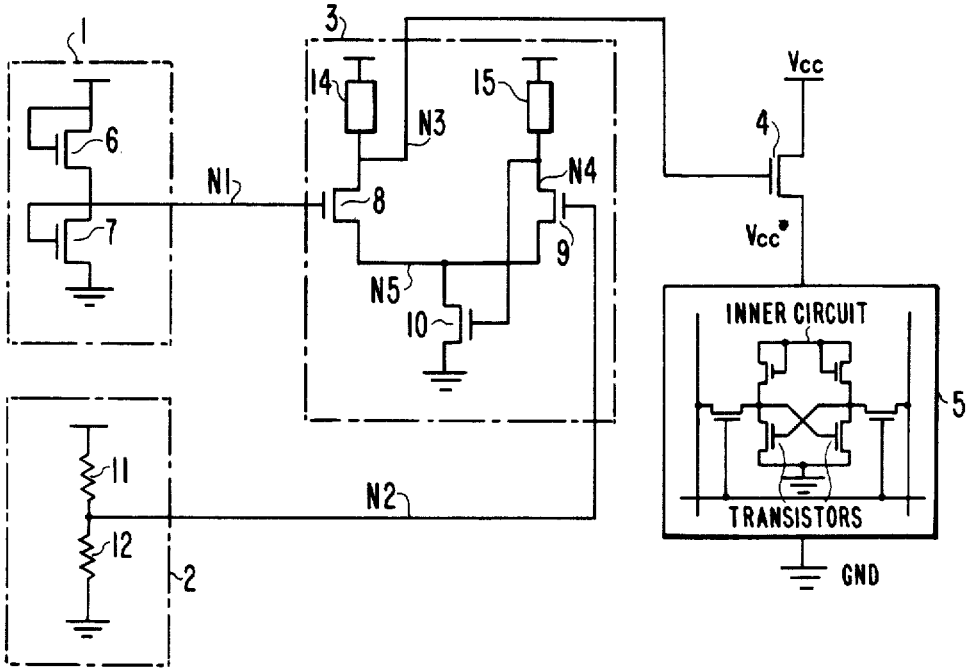
FIG. 4 is a wiring diagram of a second embodiment according to the present invention.

The regulating signal generating means 3 is basically a simple amplifier. In order to overcome the deviation of the external power supply voltage Vcc from a predetermined value, an improved controlling means is disclosed. For this purpose, a reference voltage generating means, as shown in FIG. 4, is introduced and a reference voltage signal therefrom is applied to a differential amplifier to feed back the deviation of the external power supply voltage.

The regulating means 4 is an FET. The conductance of the FET is regulated by the regulating signal applied to its gate electrode. The external power supply voltage Vcc is applied to the regulating means 4 through an external power supply line. The voltage drop across the FET is varied according to the regulated conductance of the FET, and an internal power supply voltage Vcc* is output and applied to the inner circuit 5. Thus, the external power supply voltage Vcc is regulated to provide an internal power supply voltage Vcc* corresponding to the conductance of the FETs in the semiconductor chip. In other words, compensation of fluctuations in the electrical characteristics due to production conditions can be achieved. Thus, the inherent difficulty in controlling the production of semiconductor devices such as ICs or LSIs is overcome relatively easily and economically.

Figure 2:
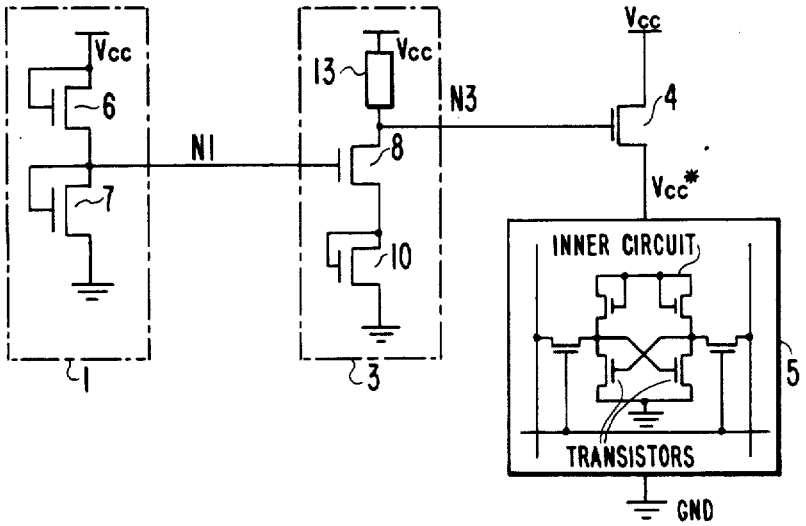
FIG. 2 is a wiring diagram of a first embodiment according to the present invention.

FIG. 2 is a circuit diagram of the first embodiment of the present invention which comprises a controlling means including a representing means 1, a regulating signal generating means 3, a voltage regulating means 4 (FET 4), and an inner circuit 5, all of which are formed on a chip. Throughout the description of the embodiments, all the FETs are assumed to be N-channel FETs unless otherwise described. In FIG. 2, the FETs 4, 7, 8 and 10 have a relatively long channel length, thus, their electrical characteristics are fairly insensitive to variations in channel length. That is, these transistors are insensitive to fluctuations due to the associated production conditions under which the FETs or relevant chips are made. On the other hand, FET 6 is a dummy FET, having a short channel length. The electrical characteristics of FET 6 respond to variations in the channel length, and is suitable for monitoring variations of the electrical characteristics of the FETs on the chip.

The representing means 1 is composed of the dummy FET 6 and a diode connected FET 7, which is a load transistor. Both FETs are connected in series at node N1. From an external power source (not shown), an external power supply voltage Vcc is applied to the drain of the FET 6 through an external power supply line (not shown) and the source of the FET 7 is connected to another power supply line (not shown), usually a ground line. The next stage is a regulating signal generator 3, including a load resistor 13, connected to the external power source supplying the voltage Vcc, an amplifying transistor FET 8 having a drain connected to the load resistor 13 at node N3, and a diode connected load transistor FET 10. The load resistor 13, FET 8 and FET 10 are connected in series to each other in the recited order. The potential of node N1 is $V_{N1}$ and is input to the gate electrode of the FET 8. The potential of node N3 is $V_{N3}$, and is applied to the gate electrode of FET 4. The FET 4 has a drain and a source connected to the external power supply line and the inner circuit 5, respectively.

Figure 3:
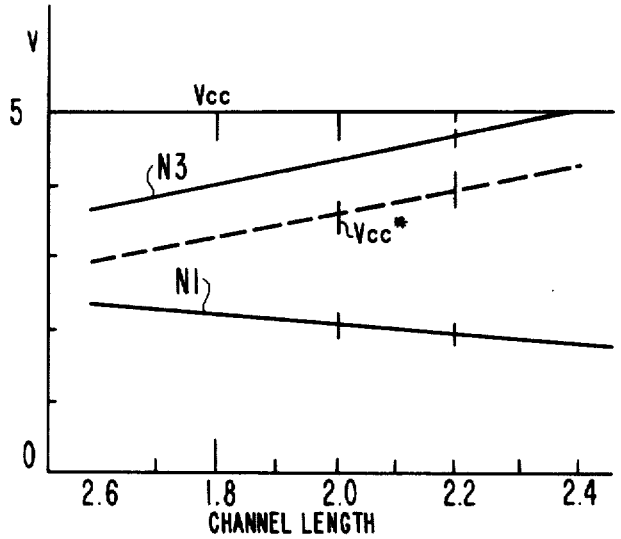
FIG. 3 is a graph of the relationship between channel length of a dummy FET and the potential at every node in the circuit of FIG. 1.

FIG. 3 is a graph of the relationship between the channel length of dummy FET 6 and potentials at various nodes shown in FIG. 2. The channel lengths are plotted on the abscissa, and the node potential corresponding to each channel length is plotted on the ordinate. As described before, the channel lengths are controlled during the production process, and are, for example, within ±0.2 μm, of their desired length. Assuming that the channel length is designed to be 2 μm, the channel length will be controlled to be within the range from 2.2 μm to 1.8 μm. The regulating circuit, including representing means 1, regulating signal generating means 3 and regulating means 4, is usually designed such that the voltage drop across FET 4 is a minimum when the channel length of the FET 6 is a maximum, i.e., 2.2 μm. When the channel length becomes shorter, the conductance of the FET 6 becomes higher, and the smaller voltage drop of the FET 6 provides a higher potential $V_{N1}$ which reduces the voltace drop across the FET 8, resulting in a lowered potential $V_{N3}$ at node $N_3$. Since the gate potential of FET 4, i.e., the potential $V_{N3}$, becomes lower, the voltage drop across FET 4 increases, providing a decreased internal power supply voltage Vcc*. The relatively low Vcc* is then applied to the inner circuit 5 which has a relatively high total conductance. As a result, the application of a higher power supply current to the chip is avoided.

The device in the first embodiment, however, is subject to unstable operation at times. For example, if the level of the external power supply voltage Vcc for the circuit shown in FIG. 2 becomes higher than the specified voltage, the potential voltages $V_{N1}$ and $V_{N3}$ rise and provide a higher Vcc* than originally desired.

In order to achieve a more stable operation, wherein the influence of the deviation of the external power supply voltage Vcc is made as small as possible, an improved second embodiment is proposed. The ultimate purpose of the second embodiment is to maintain the potential at the gate electrode of FET 4, (i.e., the node potential $V_{N3}$). That is, the node potential $V_{N3}$ is immune to deviations in the external power supply voltage Vcc.

FIG. 4 is a circuit diagram according to the second embodiment of the present invention. The second embodiment, like the first embodiment, comprises a controlling means and a regulating means 4. The controlling means includes a representing means 1, a reference voltage generating means 2 and a more complicated regulating signal generating means 3. The reference voltage generator 2 includes two resistors 11 and 12 connected in series at node N2. Resistor 11 is connected to an external power supply line, and resistor 12 is connected to the ground line. Thus, the voltage Vcc is divided in proportion to the ratio of resistances of both resistors 11 and 12, and a reference voltage having a value $V_{N2}$ is obtained.

The regulating signal generator 3 is a differential amplifier which is a well known circuit (see, for example, U.S. Pat. No. 4,375,039, issued Feb. 22, 1983, to Yamauchi), and includes three FET transistors 8, 9 and 10, and two load resistors 14 and 15. The drains of the FET transistors 8 and 9 are connected to first terminals of the load resistors 14 and 15, respectively, at respective nodes N3 and N4, and the sources of both transistors are commonly connected to a common transistor, FET 10, at node N5. The source of the FET 10 is grounded. The external power supply voltage Vcc is applied to second terminals of both load resistors 14 and 15. The differential amplifier has first and second input terminals at nodes N1 and N2, respectively, connected to the gate electrodes of the FETs 8 and 9, and two output terminals. The first output terminal is connected at node N3 which is connected to the regulating transistor FET 4. The second output terminal is connected at node N4 and is fed back to the gate electrode of the common transistor FET 10. Therefore, the reference voltage $V_{N5}$ at node N5, is variable.

The operation of the regulating signal generator 3, namely the differential amplifier in FIG. 4, will be described. A voltage signal $V_{N1}$ representative of the electrical characteristics of the associated FETs is obtained from the representing means 1 in the same manner as that of the first embodiment shown in FIG. 2. The voltage signal $V_{N1}$ is input to a first input terminal of the differential amplifier, that is, the gate electrode of FET 8. A voltage $V_{N2}$ is output from the reference voltage generating means 2 and input to a second input terminal, that is, the gate electrode of FET 9. Since the operation caused by the variation of the dummy FET 6 is the same as that of the first embodiment, it will not be discussed. However, variation of the external power supply voltace Vcc will be discussed under the assumption that the conductance of the dummy FET 6 is fixed, and only Vcc increases.

When Vcc rises to some degree, the node potentials $V_{N1}$, $V_{N2}$, $V_{N3}$, and $V_{N4}$ naturally tend to increase. For clarity, these increases in the node potentials which are directly caused by the rise in Vcc are referred to as original increases. The results of the rise in Vcc will be discussed referring to FIG. 4.

The original rise in the node potential $V_{N2}$ increases the conductance of the FET 9 with the result that the potential at the node $N_4$ decreases. Combining the original increase in the node potential $V_{N4}$ with the decrease due to the increase in the conductivity of the FET 9 results in a slight overall increase in the node potential $V_{N4}$. This increases the conductance of the FET 10, which results in a decrease in potential at the node $N_5$. Combining the original increase in $V_{N1}$ with the decrease in the node potential $V_{N5}$ at the node $N_5$ results in an overall decrease in the node potential $V_{N5}$ which increases the conductance of the FET 8, and therefore, the node potential $V_{N3}$ is decreased. Thus, the effect of the original increase in the node potential $V_{N3}$, even though not perfectly eliminated, is at least partially compensated. Therefore, the differential amplifier operates in a manner such that the effect of a rise in the external supply voltage Vcc is reduced to some degree so as to realize a more reliable operation. Of course, when the voltage Vcc is decreased from the specified voltage, the circuit operates in a reverse manner.

The present invention may be embodied in other specific forms without departing from the spirit or essential characteristics thereof. The presently disclosed embodiments are, therefore, to be considered in all respects as illustrative and not restrictive. The scope of the present invention is indicated by the appended claims, rather than the foregoing description, and all changes which come within the meaning and range of equivalency of the claims are therefore to be embraced therein.

What is claimed is:

1. A semiconductor device having an external power supply line operatively connected to receive an external power supply voltage, comprising:

a semiconductor substrate;

an inner circuit, formed on said semiconductor substrate, containing a plurality of transistors;

voltage regulating means, formed on said substrate, operatively connected to receive the external power supply voltage and operatively connected to said inner circuit, for regulating the external power supply voltage and converting the external power supply voltage to an internal power supply voltage to be applied to said inner circuit; and controlling means, formed on said semiconductor substrate and operatively connected to said voltage regulating means, for controlling said voltage regulating means in accordance with the characteristics of said transistors in said inner circuit so that variations in the electrical characteristics of said transistors are compensated in dependence upon the external power supply voltage, said controlling means comprising:

means for providing a representative signal which represents electrical characteristics of said transistors in said inner circuit;

means for generating a reference voltage in accordance with the external power supply voltage; and means, operatively connected to said means for providing a representative signal and said means for generating a reference voltage, for generating a regulating signal in accordance with said representative signal and said reference voltage.

2. A semiconductor device according to claim 1, wherein said transistors in said inner circuit are a metal insulator semiconductor field effect transistors (MISFETs).

3. A semiconductor device according to claim 1, operatively connected to a power supply line, wherein said means for providing a representative signal comprises:

a dummy transistor operativley connected to the external power supply line; and a load transistor connected in series between said dummy transistor and the power supply line, a voltage at a node between said dummy transistor and said load transistors being input to said means for generating a regulating signal as said representative signal.

4. A semiconductor device according to claim 1, operatively connected to a power supply line, wherein said means for generating a regulating signal comprises:

first load means operatively connected to the external power supply line;

an amplifying transistor operatively connected in series with said first load means; and second load means, operatively connected in series between said amplifying transistor and the power supply line, said representative signal being input to said amplifying transistor, and a voltage at a connection node of said first load means and said amplifying transistor being input to said voltage regulating means as said regulating signal.

5. A semiconductor device according to claim 1, operatively connected to a power supply line, wherein said means for generating a reference voltage comprises:

first and second resistors operatively connected in series, said first resistor connected to the external power supply line and said second resistor connected to the power supply line, a voltage at a node between said first resistor and said second resistor being input to said means for generating a regulating signal.

6. A semiconductor device according to claim 1, operatively connected to a power supply line, wherein said means for generating a regulating signal comprises:

first and second load means connected to the external power supply line;

first and second input transistors connected in series to said first and second load means, respectively; and a common transistor commonly connected between said first and second transistors and the power supply line, said representative signal and said reference voltage signal applied to said first and second input transistors, respectively, a voltage at a node between said second load means and said second input transistor being fed back to said common transistor, and a voltage at a node between said first load means and said first input transistor being input to said voltage regulating means as said regulating signal.

7. A semiconductor device according to claim 1, wherein said transistors in said controlling means, except said dummy transistor, are FETs having channel lengths sufficiently long to make the electrical characteristics of said FETs insensitive to variations in the channel lengths of said FETs.

8. A semiconductor device according to claim 3 wherein said transistors in said controlling means, except said dummy transistor, are FETs having channel lengths sufficiently long to make the electrical characteristics of said FETs substantially insensitive to any variations in the channel lengths of said FETs.

9. A semiconductor device according to claim 3, wherein said dummy transistor is an FET having a channel length sufficiently short to make the electrical characteristics of said FET substantially sensitive to variations in the channel length of said FETs in said inner circuit.

10. A semiconductor device according to claim 3, wherein said transistors in said inner circuit are metal insulator semiconductor field effect transistors (MISFETs).

11. A semiconductor device according to claim 4, wherein said transistors in said inner circuit are metal insulator semiconductor field effect transistors (MISFETs).

12. A semiconductor device according to claim 4, wherein said transistors in said controlling means, except said dummy transistor, are FETs having channel lengths sufficiently long to make the electrical characteristics of said FETs insensitive to variations in the channel lengths of said FETs.

13. A semiconductor device according to claim 5, wherein said transistors in said controlling means are metal insulator semiconductor field effect transistors (MISFETs).

14. A semiconductor device according to claim 5, wherein said transistors in said controlling means, except said dummy transistor, are FETs having channel lengths sufficiently long to make the electrical characteristics of said FETs insensitive to variations in the channel lengths of said FETs.

* * * * *

UNITED STATES PATENT AND TRADEMARK OFFICE

CERTIFICATE OF CORRECTION

PATENT NO. : 4,716,307

DATED : December 29, 1987

INVENTOR(S) : Keizo AOYAMA

It is certified that error appears in the above-identified patent and that said Letters Patent is hereby corrected as shown below:

Column 8, line 44, change "5" to --6--;
line 48, change "5" to --6--.

Signed and Sealed this
Seventh Day of June, 1988

*Attest:*

*Attesting Officer*

DONALD J. QUIGG

*Commissioner of Patents and Trademarks*